US011643897B2

(12) United States Patent
Hallundbæk

(10) Patent No.: US 11,643,897 B2
(45) Date of Patent: May 9, 2023

(54) DOWNHOLE LINE SEPARATION TOOL

(71) Applicant: Welltec A/S, Allerød (DK)

(72) Inventor: Jørgen Hallundbæk, Zug (CH)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 17/197,817

(22) Filed: Mar. 10, 2021

(65) Prior Publication Data

US 2021/0285300 A1 Sep. 16, 2021

(30) Foreign Application Priority Data

Mar. 11, 2020 (EP) ..... 20162497

(51) Int. Cl.
*E21B 29/04* (2006.01)
*E21B 23/14* (2006.01)

(52) U.S. Cl.
CPC ..... *E21B 29/04* (2013.01); *E21B 23/14* (2013.01)

(58) Field of Classification Search
CPC ..... E21B 29/04; E21B 29/06; E21B 29/08; E21B 23/14
See application file for complete search history.

(56) References Cited

U.S. PATENT DOCUMENTS 4,872,507 A * 10/1989 Ronco, Sr. ..... E21B 47/017 166/57
4,887,668 A * 12/1989 Lynde ..... E21B 29/005 408/180
6,460,636 B1 * 10/2002 Yong ..... E21B 17/1092 175/428
2009/0294127 A1 * 12/2009 Krueger ..... E21B 29/005 166/55
2010/0258289 A1 * 10/2010 Lynde ..... E21B 23/14 166/55.7
2014/0033885 A1 2/2014 Fuhst et al.
2019/0257168 A1 * 8/2019 Sunde ..... E21B 31/20

OTHER PUBLICATIONS

Extended European Search Report for EP Application No. 20162497.0 dated Aug. 13, 2020, 6 pages.

* cited by examiner

*Primary Examiner* — Christopher J Sebesta
(74) *Attorney, Agent, or Firm* — Nixon & Vanderhye P.C.

(57) ABSTRACT

The present invention relates to a downhole line separation tool for submerging into a casing in a wellbore, the downhole line separation tool having a first tool end, a second tool end and a tool axis, comprising a tool housing having a first housing part and a second housing part, an electrical motor arranged within the first housing part and powered through a wireline connected to the first tool end, an annular separation element having an element end facing away from the first tool end and being rotatably connected within the second housing part, and a rotatable shaft arranged within the second housing part and rotated by the electrical motor for rotating the annular separation element, wherein the second housing part comprises a sleeve part having a sleeve end, at least part of the annular separation element projecting from the sleeve end further away from the first tool end than the sleeve, the second housing part comprising at least one projecting part extending further away from the first tool end than the annular separation element along the tool axis. Moreover, the present invention also relates to a downhole system comprising an upper casing connected to a lower casing and arranged in the wellbore.

22 Claims, 6 Drawing Sheets

DOWNHOLE LINE SEPARATION TOOL

Figure 1:
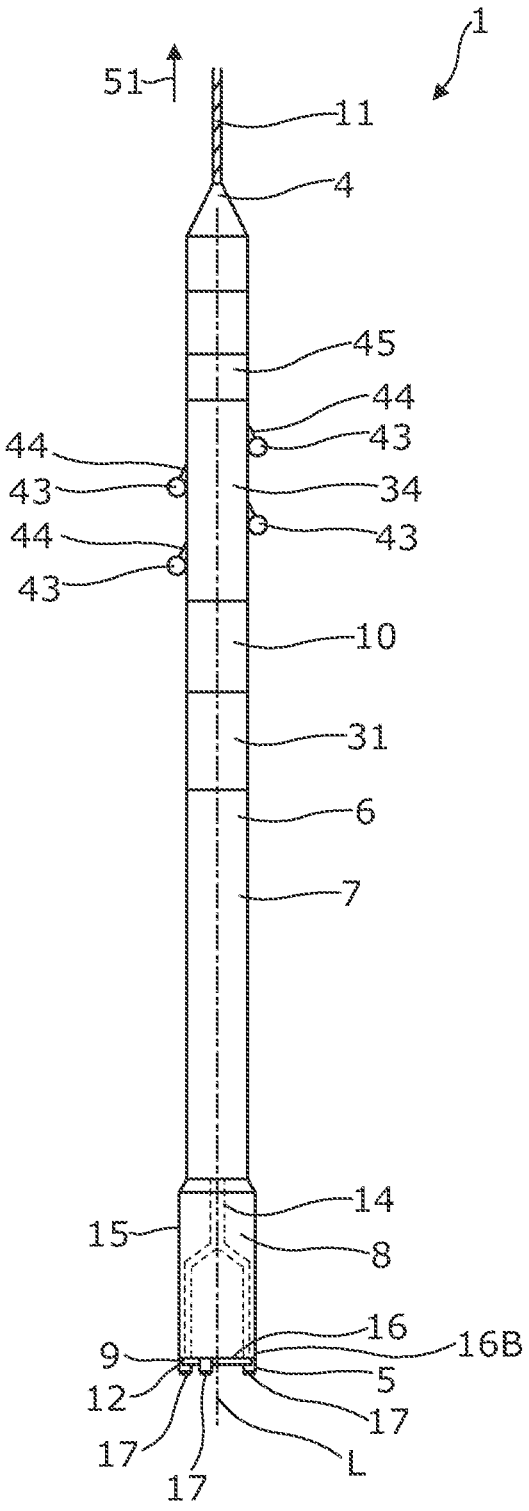

This application claims priority to European Patent Application No. 20162497.0 filed Mar. 11, 2020, the entire contents of which are hereby incorporated by reference.

The present invention relates to a downhole line separation tool for submerging into a casing in a wellbore, the downhole line separation tool having a first tool end, a second tool end and a tool axis. Moreover, the present invention also relates to a downhole system comprising an upper casing connected to a lower casing and arranged in the wellbore.

In oil and gas wells, control lines are installed running on the outside of the upper casing in order to control valves for adjusting inflow of oil or gas into the completion or closing the flow upwards inside the casing. When replacing the upper casing, the control lines are pulled out with the upper casing, and often the lines break so that the lines enter the inside of the lower casing. As the new upper casing is installed, the control lines are squeezed in between the upper and lower casing.

Some upper casings are installed with a control line cutter which is mounted as part of and on the outer face of the upper casing and thus retracted with the upper casing. However, if the control line cutter fails or the upper casing does not have such control line cutter, the operator has no other alternative than to pull out the upper casing with the risk of the control lines falling into the inside of the lower casing.

It is an object of the present invention to wholly or partly overcome the above disadvantages and drawbacks of the prior art. More specifically, it is an object to provide an improved downhole tool for separation and/or removing a stuck line in the casing.

The above objects, together with numerous other objects, advantages and features, which will become evident from the below description, are accomplished by a solution in accordance with the present invention by a downhole line separation tool for submerging into a casing in a wellbore, the downhole line separation tool having a first tool end, a second tool end and a tool axis, comprising:

- a tool housing having a first housing part and a second housing part,
- an electrical motor arranged within the first housing part and powered through a wireline connected to the first tool end,
- an annular separation element having an element end facing away from the first tool end and being rotatably connected within the second housing part, and
- a rotatable shaft arranged within the second housing part and rotated by the electrical motor for rotating the annular separation element, wherein the second housing part comprises a sleeve part having a sleeve end, at least part of the annular separation element projecting from the sleeve end further away from the first tool end than the sleeve, the second housing part comprising at least one projecting part extending further away from the first tool end than the annular separation element along the tool axis.

By having a projecting part extending beyond the annular separation element, the projecting part abuts the edge in the casing, providing the possibility of the annular separation element rotating for cutting and separating one part of the line from a remaining part of the line without harming the casing, e.g. by machining in the casing.

Also, the sleeve part may form part of the tool housing.

In addition, the sleeve part may form part of an outer face of the tool housing.

Furthermore, the sleeve end face may extend perpendicularly to the tool axis.

Moreover, the sleeve end face may form part of the front end of the tool facing downwards in the well.

Further, the at least one projecting part may extend from the sleeve end face and away from the first tool end.

Additionally, the downhole line separation tool may be battery-less.

Also, the downhole line separation tool may be a downhole line separation wireline tool.

In addition, the projecting part may have a width from the element end further along the tool axis away from the first tool end, the width being more than 0.3 mm and less than 20 mm.

Furthermore, the projecting part may have a radial extension from an inner diameter of the second housing part and radially inwards, the radial extension being more than a thickness of the annular separation element.

Also, the annular separation element may comprise several bits arranged at the element end and along a circumference of the annular separation element.

Additionally, the several bits may form an edge for abutment to and cutting into a line in a casing.

Further, the annular separation element may comprise an annular grinding bit/segment having abrasive particles arranged in the element end, forming an edge for abutment to and cutting into a line in a casing.

Moreover, the downhole line separation tool may further comprise a pump arranged between the first tool end and the second housing part and having a pump inlet in fluid communication with an inside of the annular separation element through an inside of the second housing part, and the pump having a pump outlet in the tool housing so that the pump sucks fluid in through the annular separation element, through the inside of the second housing part and out through the outlet.

In addition, the downhole line separation tool may further comprise an accumulation section arranged between the element end of the annular separation element and the pump.

Furthermore, the accumulation section may comprise an accumulation housing enclosing an accumulation chamber in which a filtering element is arranged, and the accumulation section is arranged between the element end of the annular separation element and the pump so that fluid is sucked in through the annular separation element into the accumulation chamber and further in through the filtering element and in through the pump inlet.

Also, the accumulation housing may form part of the tool housing.

Additionally, the downhole line separation tool may further comprise a gearing section connected between the electrical motor and the rotatable shaft for reducing the rotation of the annular separation element in relation to the rotational output of the motor.

Moreover, the downhole line separation tool may further comprise an anchoring tool section for preventing the tool from rotating within the casing.

Further, the anchoring tool section may comprise projectable anchoring elements.

In addition, the downhole line separation tool may further comprise an axial force generator providing an axial force along the tool axis.

Also, the downhole line separation tool may further comprise a driving unit, such as a downhole tractor, for preventing the tool from rotating within the casing and for providing an axial force along the tool axis.

Furthermore, the downhole line separation tool may be a wireline tool.

Additionally, the driving unit may comprise a second motor driving a second pump for rotating wheels and projecting arms onto which the wheels are arranged.

Moreover, the downhole line separation tool may comprise a compensator for providing a surplus pressure inside the downhole line separation tool.

In addition, the annular separation element may have at least one cutting bit forming the element end.

Further, the tool housing having the first housing part and the second housing part may be stationary.

Also, the second housing part may have a larger outer diameter than an outer diameter of the first housing part.

Furthermore, the second housing part may have approximately the same diameter as the first housing part, and the bit(s) may be made to fit inside it.

Finally, the present invention also relates to a downhole system comprising an upper casing connected to a lower casing and arranged in the wellbore, and the lower casing having an inner diameter being smaller than an inner diameter of the upper casing providing a circumferential edge of the lower casing, the downhole system further comprising a downhole line separation tool wherein the projecting part abuts the circumferential edge of the lower casing.

Figure 2:
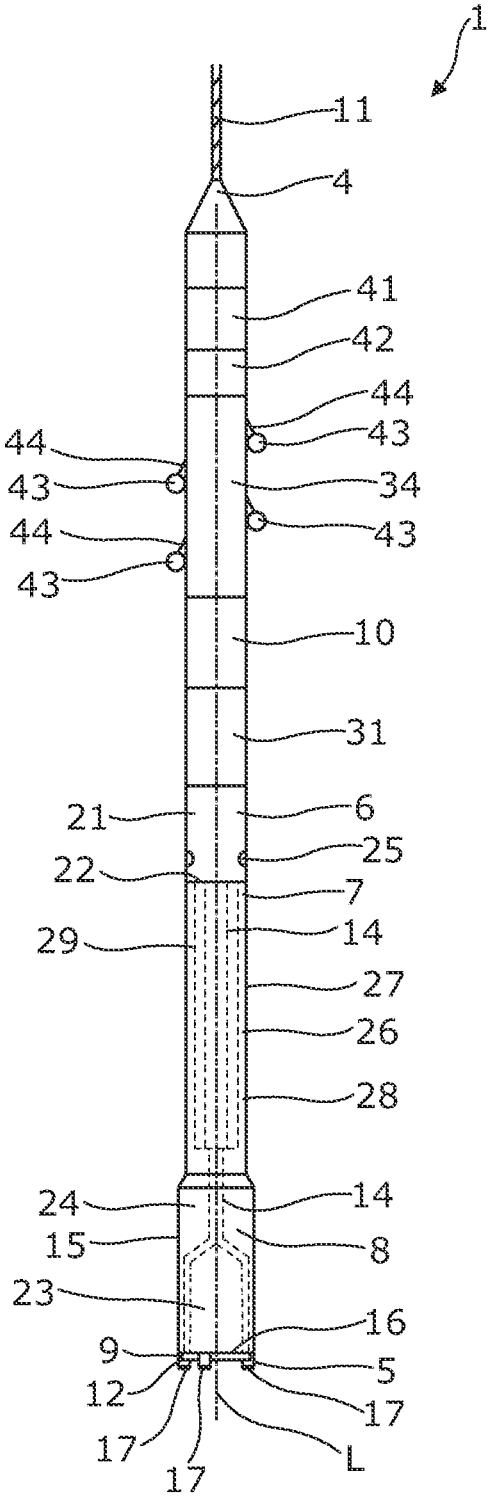
Figure 3:
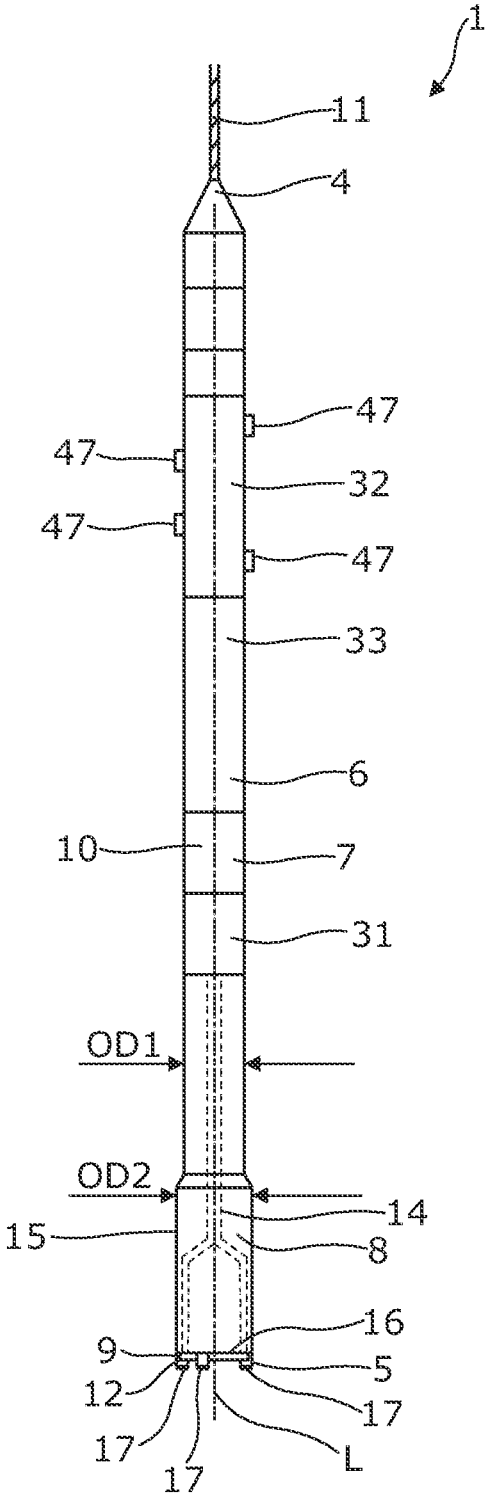
Figure 4:
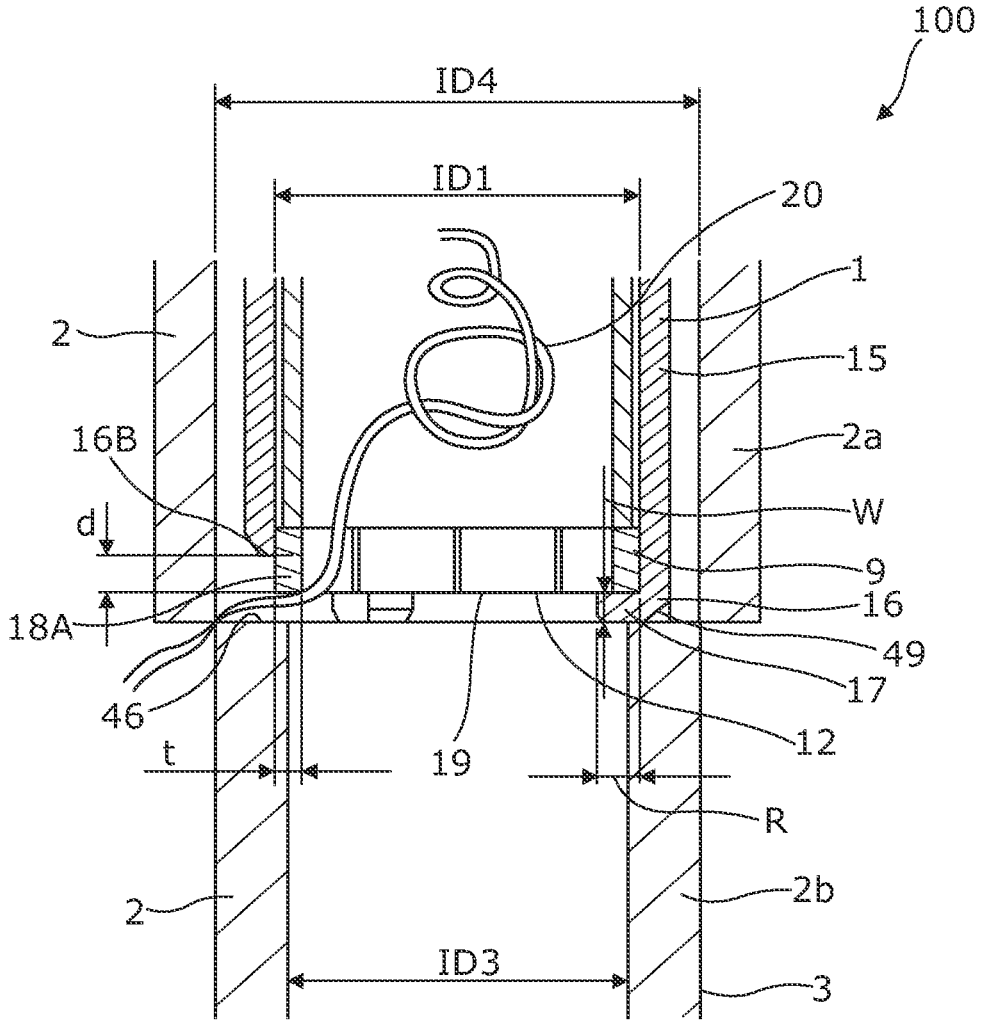
Figure 5:
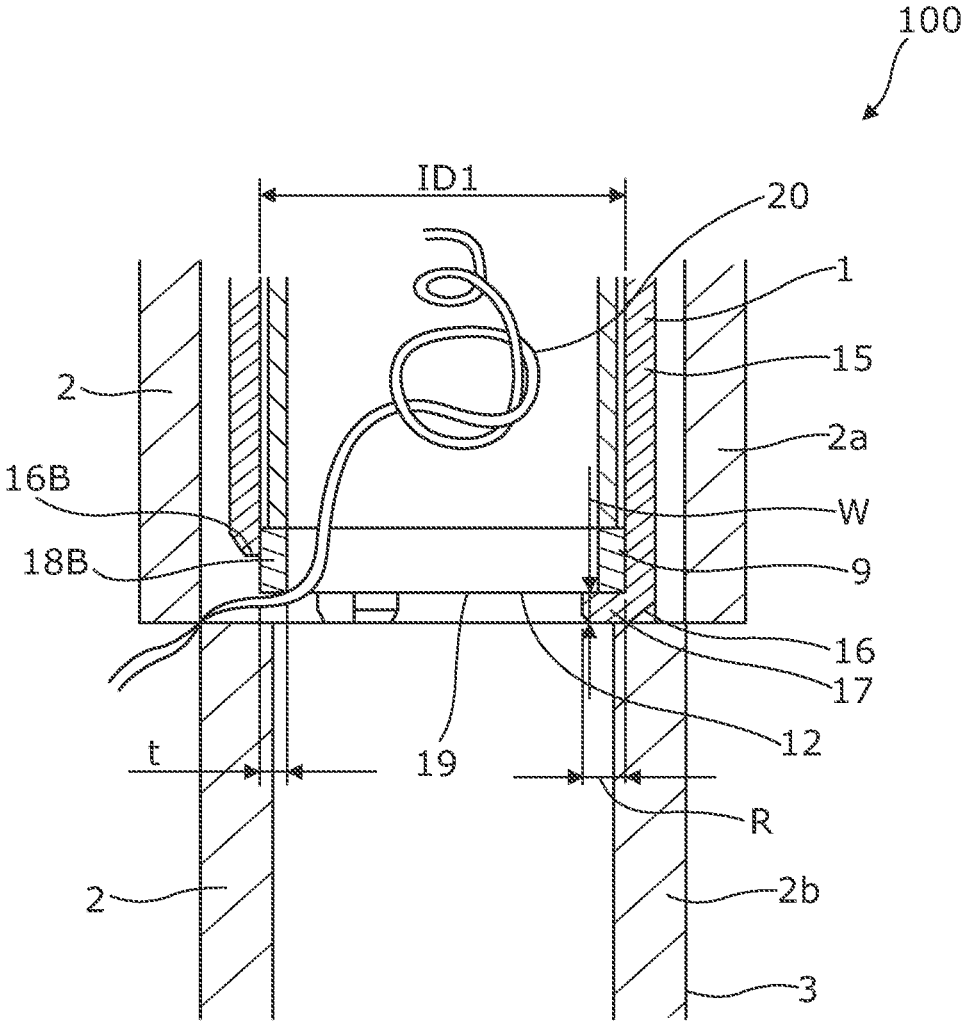
Figure 6:
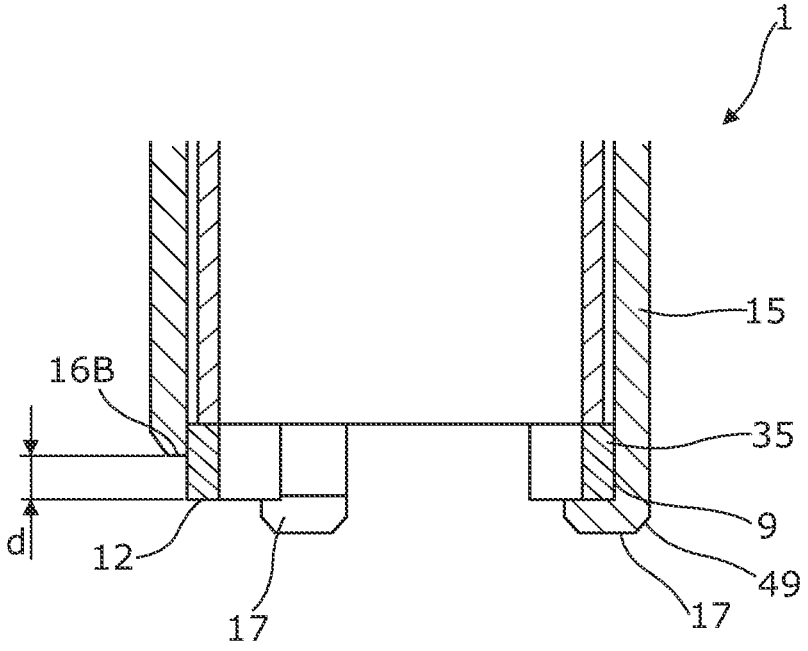

The invention and its many advantages will be described in more detail below with reference to the accompanying schematic drawings, which for the purpose of illustration show some non-limiting embodiments and in which:

FIG. 1 shows a downhole line separation tool for cutting a line lost within a casing, FIG. 2 shows another downhole line separation tool, FIG. 3 shows yet another downhole line separation tool, FIG. 4 shows a partial cross-sectional view of part of the downhole line separation tool having an annular separation element when separation a part of a control line from another part of the control line on the outside of the casing, FIG. 5 shows a partial cross-sectional view of part of another downhole line separation tool, and FIG. 6 shows a partial cross-sectional view of part of yet another downhole line separation tool.

All the figures are highly schematic and not necessarily to scale, and they show only those parts which are necessary in order to elucidate the invention, other parts being omitted or merely suggested.

FIG. 1 shows a downhole line separation tool 1 for submerging into a casing 2 (shown in FIG. 4) in a wellbore 3 (shown in FIG. 4). The downhole line separation tool has a first tool end 4 nearest a top 51 (illustrated by an arrow in FIG. 1) of the well, a second tool end 5 furthest away from the top of the well and a tool axis L. The downhole line separation tool comprises a tool housing 6 having a first housing part 7 and a second housing part 8. The downhole line separation tool further comprises an electrical motor 10 arranged within the first housing part and powered through a wireline 11 connected to the first tool end. Thus, the downhole line separation tool is a wireline tool and is an intervention tool for intervening a well. In the second tool end, the downhole line separation tool comprises an annular separation element 9 having an element end 12 facing away from the first tool end and being rotatably connected within the second housing part by means of a rotatable shaft 14 arranged within the second housing part and rotated by the electrical motor for rotating the annular separation element 9. The second housing part comprises a sleeve part 15 having a sleeve end face 16B. As can be seen, part of the annular separation element 9 projects from the sleeve end face 16B and projects further away from the first tool end than the sleeve end face. The second housing part also comprises a projecting part 17 extending further away from the first tool end than the annular separation element along the tool axis L. Thus, the at least one projecting part 17 extends from the sleeve end face 16B and away from the first tool end. In this way, the annular separation element 9 is exposed for cutting or grinding into the control line 20 (shown in FIG. 4) except when passing the projecting part 17 when rotating underneath the projecting part. The tool housing 6 having the first housing part 7 and the second housing part 8 is stationary while the annular separation element 9 is rotating.

As seen in FIG. 1, the downhole line separation tool 1 is a downhole line separation wireline tool as the tool is powered through a wireline 11 connected to the first tool end. Thus, the downhole line separation tool 1 is battery-less.

As shown in FIG. 4, the projecting part 17 abuts a circumferential edge 46 of the lower casing resulting from an upper casing 2*a* connected to the lower casing 2*b* where the lower casing has an inner diameter ID3 being smaller than an inner diameter ID4 of the lower casing, providing the circumferential edge 46 of the lower casing. When inserting the upper casing, a control line 20 or other type of line has fallen into the casing and is squeezed in between the upper casing and the lower casing. The bits 18A of annular separation element 9 cut or grind into the control line, separating the part of the control line extending into the casing from the remaining part. Having a control line floating within the casing can, among other things, prohibit the upper casing from being properly installed, resulting in a leak, and/or that intervention tools can operate in the well.

Thus, by having a projecting part 17 extending beyond the annular separation element 9, the projecting part 17 is stationary abutting the edge in the casing, providing the possibility of the annular separation element 9 rotating for cutting and separating one part of the line from a remaining part of the line without harming the casing, e.g. by machining in the casing.

As shown in FIG. 4, the projecting part has a width w from the element end further along the tool axis away from the first tool end. The width may be more than 0.3 mm and less than 20 mm. Control lines often have an outer diameter of more than 0.3 mm and less than 20 mm, and the width of the projecting part is designed to correspond to the outer diameter of the control line to be cut or ground. The projecting part has a radial extension R from an inner diameter ID1 of the second housing part and radially inwards. The radial extension may be more than a thickness t of the annular separation element.

In FIG. 4, the annular separation element 9 comprises several bits 18A arranged at the element end 12 and along a circumference of the annular separation element 9. The several bits 18A form an edge 19 abutting and cutting into the control line 20 in the casing 2. The annular separation element may thus be formed of several bits or inserts forming the edge abutting and cutting into the control line 20 in the casing 2.

As can be seen, the sleeve end face 16B extends perpendicularly to the tool axis L along the circumference of the tool. The sleeve end face 16B forms part of the front end of the tool facing downwards in the well.

In FIG. 5, the annular separation element 9 comprises an annular grinding bit 18B having abrasive particles, the annular grinding bit being arranged in the element end 12 forming an edge 19 abutting and grinding into the control line 20 in the casing. The annular grinding bit 18B may in another embodiment be comprised of several grinding bits when mounted closely together along the circumference of the annular separation element to form a common annular grinding bit.

In FIG. 2, the downhole line separation tool 1 comprises a pump 21 arranged between the first tool end 4 and the second housing part 8. The pump 21 has a pump inlet 22 in fluid communication with an inside 23 of the annular separation element 9 through an inside 24 of the second housing part 8. The pump 21 has a pump outlet 25 in the wall of the tool housing 6 so that the pump sucks fluid in through the annular separation element 9 through the inside of the second housing part and out through the outlet. The downhole line separation tool 1 further comprises an accumulation section 26 arranged between the element end 12 of the annular separation element 9 and the pump 21. As indicated by dotted lines, the accumulation section 26 comprises an accumulation housing 27 enclosing an accumulation chamber 28 in which a filtering element 29 is arranged. The accumulation section 26 is arranged between the element end 12 of the annular separation element 9 and the pump 21 so that well fluid is sucked in through the annular separation element 9 into the accumulation chamber 28 and further in through the filtering element 29 and in through the pump inlet 22. The accumulation housing 27 forms part of the tool housing 6.

The downhole line separation tool 1 may further comprise a gearing section 31 as shown in FIG. 1. The gearing section 31 is connected between the electrical motor 10 and the rotatable shaft 14 for reducing the rotation of the annular separation element 9 in relation to the rotational output of the motor 10. The downhole line separation tool 1 further comprises a driving unit 34, such as a downhole tractor, for preventing the tool from rotating within the casing and for providing an axial force along the tool axis. The downhole line separation tool further comprises a compensator 45 for providing a surplus pressure inside the downhole line separation tool.

As shown in FIG. 2, the driving unit comprises a second motor 41 driving a second pump 42 for rotating wheels 43 and projecting arms 44 onto which the wheels are arranged.

In FIG. 3, the downhole line separation tool 1 comprises an anchoring tool section 32 for preventing the tool from rotating within the casing. The anchoring tool section comprises projectable anchoring elements 47 projectable for abutting an inner face of the casing. The downhole line separation tool 1 further comprises an axial force generator 33 providing an axial force along the tool axis so that the annular separation element 9 is forced towards the control line and the circumferential edge 46 (shown in FIGS. 4 and 5).

The projecting part 17 has an inclined outer end face 49 so that the projecting parts can align the tool in the casing as shown in FIG. 4. Furthermore, by having such inclined outer end face 49, the projecting part 17 can also better fit into place on top of the circumferential edge 46 of the lower casing 2*b*.

As shown in FIG. 4, a part of the annular separation element 9 projects from a sleeve end face 16B of the sleeve end 16 and projects further away from the first tool end than the sleeve, creating a distance d from the element end 12 to a sleeve end face 16B. In this way, the annular separation element 9 is free to separate the control line 20 into one or more pieces by cutting or grinding or other types of machining processes. These pieces may be sucked into the accumulation section 26 by means of the pump 21, shown in FIG. 2. The well fluid carries the pieces into the accumulation chamber 28 and is sucked further in through the filtering element 29, leaving the pieces in the annular cavity between the accumulation chamber 28 and the filtering element 29. Thus, the pieces are accumulated in the accumulation section 26 and are brought to surface when retracting the tool from the well after end of operation.

The annular separation element 9 has at least one cutting bit 35 forming the element end 12, and in FIG. 6 the annular separation element 9 has two cutting bits 35. In another embodiment, the annular separation element 9 has more than two cutting bits.

As seen in FIG. 3, the second housing part 8 has a larger outer diameter OD1 than an outer diameter OD2 of the first housing part 7. Hereby, the second housing part can abut a lower casing having a smaller inner diameter, while the smaller outer diameter of the first housing part provides room for, e.g., the wheels of the driving unit or the anchoring elements of an anchoring section. In another embodiment, the second housing part 8 has approximately the same diameter as the first housing part 7, and the bit(s) is/are made to fit inside it.

The sleeve part 15 may form part of the tool housing 6. The sleeve part 15 may also form part of an outer face of the tool housing 6.

Even though not shown, the downhole line separation tool 1 may also be used to cut a bundle of wireline lost/dropped in the well into small pieces so that such pieces can be sucked into a tool and thus retrieved from the well. The projecting parts 17 of the downhole line separation tool 1 engage the bundle so that the bundle cannot rotate with the annular separation element 9. As the projecting parts 17 are able to at least partly fixate the bundle of wireline, the annular separation element 9 is able to separate the wireline into pieces by cutting or abrasive machining.

The invention also relates to a downhole system 100 as partly shown in FIGS. 4 and 5. The downhole system 100 comprises an upper casing 2*a* connected to a lower casing 2*b* and arranged in the wellbore 3. The lower casing 2*b* has an inner diameter ID3 which is smaller than an inner diameter ID4 of the upper casing 2*a*, providing a circumferential edge 46 of the lower casing. The downhole system 100 further comprises the above-mentioned downhole line separation tool 1, wherein the projecting part 17 abuts the circumferential edge 46 of the lower casing 2*b*.

An axial force generator may be a stroking tool and is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole line separation tool for submerging into a casing in a wellbore, the downhole line separation tool having a first tool end, a second tool end and a tool axis, comprising:

a tool housing having a first housing part and a second housing part, an electrical motor arranged within the first housing part and powered through a wireline connected to the first tool end, an annular separation element having an element end facing away from the first tool end and being rotatably connected within the second housing part, and a rotatable shaft arranged within the second housing part and rotated by the electrical motor for rotating the annular separation element, wherein the second housing part comprises a sleeve part having a sleeve end face, at least part of the annular separation element projecting from the sleeve end face further away from the first tool end in a direction of the tool axis than the sleeve end face, the second housing part comprising at least one projecting part extending further away from the first tool end in the direction along the tool axis than the annular separation element along the tool axis, and wherein, when cutting of the downhole line, the annular separation element is configured to move exclusively along the tool axis whilst rotating.

2. A downhole line separation tool according to claim 1, wherein the projecting part has a width from the element end further along the tool axis away from the first tool end, the width being more than 0.3 mm and less than 20 mm.

3. A downhole line separation tool according to claim 1, wherein the projecting part has a radial extension from an inner diameter of the second housing part and radially inwards, the radial extension being more than a thickness of the annular separation element.

4. A downhole line separation tool according to claim 1, wherein the annular separation element comprises several bits arranged at the element end and along a circumference of the annular separation element.

5. A downhole line separation tool according to claim 1, wherein the annular separation element comprises an annular grinding bit having abrasive particles arranged in the element end, forming an edge for abutment to and cutting into a line in a casing.

6. A downhole line separation tool according to claim 1, further comprising a pump arranged between the first tool end and the second housing part and having a pump inlet in fluid communication with an inside of the annular separation element through an inside of the second housing part, and the pump having a pump outlet in the tool housing so that the pump sucks fluid in through the annular separation element through the inside of the second housing part and out through the outlet.

7. A downhole line separation tool according to claim 6, further comprising an accumulation section arranged between the element end of the annular separation element and the pump.

8. A downhole line separation tool according to claim 7, wherein the accumulation section comprises an accumulation housing enclosing an accumulation chamber in which a filtering element is arranged, and the accumulation section is arranged between the element end of the annular separation element and the pump so that fluid is sucked in through the annular separation element into the accumulation chamber and further in through the filtering element and in through the pump inlet.

9. A downhole line separation tool according to claim 1, further comprising a gearing section connected between the electrical motor and the rotatable shaft for reducing the rotation of the annular separation element in relation to the rotational output of the motor.

10. A downhole line separation tool according to claim 1, further comprising an anchoring tool section for preventing the tool from rotating within the casing.

11. A downhole line separation tool according to claim 1, further comprising an axial force generator providing an axial force along the tool axis.

12. A downhole line separation tool according to claim 1, further comprising a driving unit configured to prevent the tool from rotating within the casing and configured to provide an axial force along the tool axis.

13. A downhole line separation tool according to claim 1, wherein the annular separation element has at least one cutting bit forming the element end.

14. A downhole line separation tool according to claim 1, wherein the second housing part has a larger outer diameter than an outer diameter of the first housing part.

15. A downhole line separation tool according to claim 1, wherein the entirety of the annular separation element is configured to be positioned radially inside the sleeve during cutting of the downhole line.

16. A downhole line separation tool according to claim 1, wherein, when cutting of the downhole line, the annular separation element is configured to move exclusively along the tool axis whilst rotating.

17. A downhole line separation tool according to claim 1, wherein the element end has a cutting edge forming at the terminal end of the separation element.

18. A downhole line separation tool according to claim 1, wherein the at least part of the annular separation element forms a terminal end of the tool, and the at least one projecting part forms a terminal end of the tool.

19. A downhole line separation tool according to claim 1, wherein during cutting, the at least one projecting part is configured to engage the downhole line so that the downhole line cannot rotation with the separation element.

20. A downhole line separation tool according to claim 1, wherein the at least one projecting part covers a terminal end of the annular separation element such that the projecting part prevents the annular separation element from cutting along a first circumferential portion of the tool, and the element end of the annular separation element axially extends further along the tool axis compared to a terminal end of the second housing part along a second circumferential portion of the tool.

21. A downhole line separation tool according to claim 1, wherein the element end of the annular separation element axially extends further along the tool axis compared to a terminal end of the second housing part.

22. A downhole system comprising an upper casing connected to a lower casing and arranged in the wellbore, and the lower casing having an inner diameter being smaller than an inner diameter of the upper casing, providing a circumferential edge of the lower casing, the downhole system further comprising a downhole line separation tool according to claim 1, wherein the projecting part abuts the circumferential edge of the lower casing.

* * * * *